US010732538B2

(12) United States Patent
Moriai et al.

(10) Patent No.: US 10,732,538 B2
(45) Date of Patent: Aug. 4, 2020

(54) DEVELOPING MEMBER, PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Wataru Moriai, Suntou-gun (JP); Minoru Nakamura, Mishima (JP); Toru Ishii, Mishima (JP); Kazutoshi Ishida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/672,770

(22) Filed: Nov. 4, 2019

(65) Prior Publication Data

US 2020/0166866 A1 May 28, 2020

(30) Foreign Application Priority Data

Nov. 26, 2018 (JP) ..... 2018-220277
Oct. 25, 2019 (JP) ..... 2019-194684

(51) Int. Cl.
*G03G 15/08* (2006.01)
*G03G 21/18* (2006.01)

(52) U.S. Cl.
CPC ..... *G03G 15/0808* (2013.01); *G03G 15/0818* (2013.01); *G03G 21/1803* (2013.01); *G03G 2215/0861* (2013.01)

(58) Field of Classification Search
CPC ..... G03G 15/0808; G03G 15/0818; G03G 21/1803; G03G 2215/0861
See application file for complete search history.

(56) References Cited

U.S. PATENT DOCUMENTS 7,727,134 B2 6/2010 Nakamura et al.
7,797,833 B2 9/2010 Nakamura et al.
(Continued)

FOREIGN PATENT DOCUMENTS

JP 2007-279574 10/2007
JP 2008-139466 6/2008
(Continued)

OTHER PUBLICATIONS

U.S. Appl. No. 16/540,463, filed Aug. 14, 2019, Noriyuki Doi.
(Continued)

*Primary Examiner* — Joseph S Wong
(74) *Attorney, Agent, or Firm* — Venable LLP

(57) ABSTRACT

The developing member has an electroconductive substrate, and an elastic layer having a mono-layer structure on the substrate as a surface layer, wherein the elastic layer has a thickness of T μm and a volume resistivity of $1.0\times10^{5}$ Ω·cm to $1.0\times10^{12}$ Ω·cm, and includes a first resin as a main binder; and the elastic layer further includes a second resin having a structural unit represented by Formula (1), in a region extending toward a first surface from a second surface by a depth of t μm, where the first surface is defined as a surface of the elastic layer on a side facing the substrate, and the second surface is defined as a surface thereof opposite to the
(Continued)

first surface, wherein in the region, a concentration of ether bonds is higher on the second surface side than on the first surface side (provided that T>t):

Formula (1)

7 Claims, 4 Drawing Sheets

(56) References Cited

U.S. PATENT DOCUMENTS

| | | | |
|---|---|---|---|
| 7,798,948 | B2 | 9/2010 | Kawamura et al. |
| 7,799,398 | B2 | 9/2010 | Nakamura et al. |
| 8,600,273 | B2 | 12/2013 | Yamada et al. |
| 8,655,222 | B2 | 2/2014 | Nakamura et al. |
| 8,660,472 | B2 | 2/2014 | Kurachi et al. |
| 8,706,011 | B2 | 4/2014 | Anan et al. |
| 8,768,227 | B2 | 7/2014 | Urushihara et al. |
| 8,798,508 | B2 | 8/2014 | Yamada et al. |
| 8,837,985 | B2 | 9/2014 | Ishida et al. |
| 8,846,287 | B2 | 9/2014 | Yamada et al. |
| 8,874,007 | B2 | 10/2014 | Kawamura et al. |
| 8,913,930 | B2 | 12/2014 | Ishii et al. |
| 9,017,239 | B2 | 4/2015 | Ishida et al. |
| 9,482,986 | B2 | 11/2016 | Sakurai et al. |
| 9,625,854 | B2 | 4/2017 | Koyanagi et al. |
| 9,846,407 | B2 | 12/2017 | Nakamura et al. |
| 9,921,518 | B2 | 3/2018 | Sakurai et al. |
| 9,952,531 | B2 | 4/2018 | Ishii et al. |
| 9,952,532 | B2 | 4/2018 | Sugiyama et al. |
| 10,082,741 | B2 | 9/2018 | Ishida et al. |
| 10,310,447 | B2 | 6/2019 | Morishita et al. |
| 10,539,891 | B1 | 1/2020 | Ishii et al. |
| 2013/0051859 | A1* | 2/2013 | Matsuda ..... G03G 15/0921 399/252 |
| 2013/0130022 | A1 | 5/2013 | Uesugi et al. |
| 2013/0230336 | A1* | 9/2013 | Tomari ..... G03G 15/0233 399/111 |
| 2016/0154323 | A1* | 6/2016 | Nishioka ..... G03G 15/0818 492/18 |
| 2017/0139336 | A1 | 5/2017 | Nagaoka et al. |
| 2019/0265609 | A1 | 8/2019 | Sakurai et al. |
| 2019/0324382 | A1 | 10/2019 | Sugiyama et al. |
| 2020/0041921 | A1 | 2/2020 | Yamaguchi et al. |
| 2020/0041926 | A1 | 2/2020 | Ishida et al. |
| 2020/0041927 | A1 | 2/2020 | Urushihara et al. |
| 2020/0041928 | A1 | 2/2020 | Tsuru et al. |

FOREIGN PATENT DOCUMENTS

| | | |
|---|---|---|
| JP | 2009-237358 | 10/2009 |
| JP | 2012-194233 | 10/2012 |

OTHER PUBLICATIONS

U.S. Appl. No. 16/541,732, filed Aug. 15, 2019, Kazuhito Wakabayashi.
U.S. Appl. No. 16/545,434, filed Aug. 20, 2019, Kenta Matsunaga.
U.S. Appl. No. 16/569,768, filed Sep. 13, 2019, Fumihiko Utsuno.
U.S. Appl. No. 16/695,754, filed Nov. 26, 2019, Kazutoshi Ishida.

* cited by examiner

DEVELOPING MEMBER, PROCESS CARTRIDGE, AND ELECTROPHOTOGRAPHIC IMAGE FORMING APPARATUS

BACKGROUND OF THE INVENTION

Field of the Invention

The present disclosure relates to a developing member incorporated in an apparatus employing an electrophotographic system. The present disclosure also relates to a process cartridge and an electrophotographic image forming apparatus that have the developing member.

Description of the Related Art

Japanese Patent Application Laid-Open No. 2009-237358 discloses, in Example 5 and Example 6, an electroconductive roller for electrophotographic equipment, which includes: a shaft body; a base layer formed on an outer circumference of the shaft body and including electroconductive carbon black and silicone rubber; and a surface layer formed on the base layer, wherein the surface layer is formed of a cured product of a resin composition that contains polytetramethylene glycol diglycidyl ether as a main component and a cationic photopolymerization initiator.

The present inventors have investigated the case where the electroconductive roller disclosed in Japanese Patent Application Laid-Open No. 2009-237358 has been used as a developing roller. As a result, the present inventors have found that the electroconductive roller can suppress the charge up of a toner in a low temperature and low humidity environment such as a temperature of 15° C. and a relative humidity of 10%. This is considered to be because even if a toner particle on the developing roller is excessively charged due to the high molecular mobility of an ether bond derived from a glycidyl group present in the surface layer, the developing roller can make an excessive charge of the toner particle escape to the surface layer.

On the other hand, in the electroconductive roller, the charge of the toner carried on the surface may become nonuniform, in a high temperature and high humidity environment such as a temperature of 30° C. and a relative humidity of 85%.

SUMMARY OF THE INVENTION

One aspect of the present disclosure is directed to providing a developing member that can stably form high-quality electrophotographic images in various usage environments. In addition, another aspect of the present disclosure is directed to providing an electrophotographic image forming apparatus that can stably form high-quality electrophotographic images under various usage environments.

Further another aspect of the present disclosure is directed to providing a process cartridge that contributes to the formation of stable and high-quality electrophotographic images under various usage environments.

According to one aspect of the present disclosure, there is provided a developing member for electrophotography having an electroconductive substrate, and having an elastic layer having a mono-layer structure on the substrate as a surface layer, wherein the elastic layer has a thickness of T μm and a volume resistivity of $1.0\times10^{5}$ Ω·cm or more and $1.0\times10^{12}$ Ω·cm or less; and the elastic layer includes a first resin as a main binder, and the elastic layer further includes a second resin having a structural unit represented by the following Structural Formula (1), in a region extending toward a first surface from a second surface by a depth oft μm, where the first surface is defined as a surface of the elastic layer on a side facing the substrate, and the second surface is defined as a surface thereof opposite to the first surface, wherein in the region, a concentration of ether bonds represented by —C—O—C—, is higher on the second surface side than on the first surface side (provided that T>t):

Structural Formula (1)

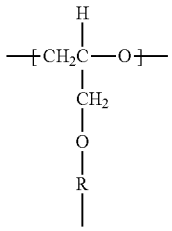

wherein R represents a linear or branched hydrocarbon group having 1 to 6 carbon atoms.

In addition, according to another aspect of the present disclosure, there is provided a process cartridge that is configured to be detachably attachable to a main body of an electrophotographic image forming apparatus, and has the above developing member.

Furthermore, according to one aspect of the present disclosure, there is provided an electrophotographic image forming apparatus that includes: an image carrier for carrying an electrostatic latent image thereon; a charging apparatus for primarily charging the image carrier; an exposure apparatus for forming an electrostatic latent image on the primarily charged image carrier; a developing member for developing the electrostatic latent image by a toner to form a toner image; and a transfer apparatus for transferring the toner image to a transfer material, wherein the developing member is the above developing member.

Further features of the present invention will become apparent from the following description of exemplary embodiments with reference to the attached drawings.

DESCRIPTION OF THE EMBODIMENTS

Figure 1A:
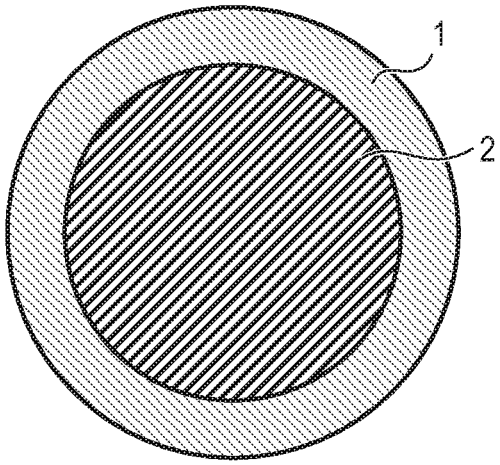
FIGS. 1A and 1B show a conceptual diagram illustrating one example of a developing member according to the present disclosure.

Preferred embodiments of the present invention will now be described in detail in accordance with the accompanying drawings.

The present inventors have assumed the reason why the charging uniformity of the toners is impaired due to the use in a high temperature and high humidity environment, when the electroconductive roller according to Japanese Patent Application Laid-Open No. 2009-237358, which has a surface layer having an ether bond on an electroconductive base layer, is used as a developing roller, as follows. In other words, the present inventors have assumed that the electroconductivity of the surface layer having the ether bond increases in the high temperature and high humidity environment, and the charges excessively leak from toner particles in direct contact with the outer surface of the electroconductive roller among the toner particles constituting the toner layer on the electroconductive roller, to the surface layer and further to the base layer, and thereby the charges which the toners bear become non-uniform.

Then, the present inventors have investigated an electroconductive roller in which the electroconductivity of the base layer of the electroconductive roller according to Japanese Patent Application Laid-Open No. 2009-237358 has been lowered. However, in such an electroconductive roller, in some cases, charges are gradually accumulated at the interface between the surface layer and the base layer, and as a result, the electroconductive roller itself is excessively charged, and the excessively charged electroconductive roller may change a developing bias and affect the image quality of an electrophotographic image.

Then, the present inventors have proceeded with the investigation for the purpose of obtaining a developing member for electrophotography which can receive charges from excessively charged toner particles in the low temperature and low humidity environment, can also suppress flow of more charges from the toner particles than required in the high temperature and high humidity environment, and can prevent the developing member itself from excessively accumulating the charges (charge up).

As a result, it has been found that a developing member having the following requirements i) to iii) can achieve the above purpose well.

i) An elastic layer having a mono-layer structure which is a surface layer has a thickness of T μm and a volume resistivity of $1.0\times10^5$ Ω·cm or more and $1.0\times10^{12}$ Ω·cm or less.

ii) The elastic layer contains a first resin as a main binder; and the elastic layer further contains a second resin having a structural unit represented by the following Structural Formula (1), in a region extending toward a first surface from a second surface by a depth oft μm, where the first surface is defined as a surface of the elastic layer on a side facing the substrate, and the second surface is defined as a surface thereof opposite to the first surface (provided that T>t):

Structural Formula (1)

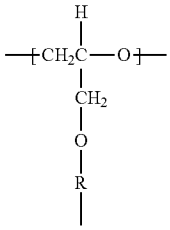

wherein R represents a linear or branched hydrocarbon group having 1 to 6 carbon atoms.

iii) In the region, a concentration of ether bonds represented by —C—O—C—, is higher on the second surface side than on the first surface side.

The present inventors consider the reason why the developing member having such a specific structure can suppress the charge up in the low temperature and low humidity environment and the leakage of the toner charge in the high temperature and high humidity environment, as follows.

Regarding the requirement i), first, the elastic layer which is the surface layer is formed to be a mono-layer. Thereby, an interface at which when excessive charges of the toners leak the charges are accumulated does not exist in the surface layer.

In addition, in general, a countermeasure of reducing the volume resistivity of the elastic layer is taken, in order to suppress the charge up of the developing member. Here, in a region in which the photosensitive member comes into contact with the developing member through the toners, a voltage by which a force acts from the photosensitive member to the developing member is applied to the charged toner, in a non-printing part. Because of this, when the volume resistivity of the whole surface layer is lowered so that charge up can be suppressed, the charges of the toners leak to the developing member due to the voltage applied as described above, in the region in which the photosensitive member comes into contact with the developing member and the voltage is applied, and thereby the charging distribution of the toners becomes non-uniform in some cases.

Because of this, when the volume resistivity of the elastic layer having a mono-layer structure which is the surface layer is set at $1.0\times10^5$ Ω·cm or more and $1.0\times10^{12}$ Ω·cm or less, an excessive leakage of charges from the toners to the developing member can be prevented.

Next, regarding the configuration requirement ii), the elastic layer contains the first resin as the main binder, and also contains the second resin having the structural unit represented by Structural Formula (1), in the region from the outer surface (second surface) of the developing member down to the depth of t μm (hereinafter, simply referred to as "surface region" in some cases). Due to the second resin that has the structural unit containing the ether bond represented by —C—O—C— and is contained in the surface region, transfer of charges is promoted from the toner particles to the surface region, which are excessively charged in the low temperature and low humidity environment. As a result, the charging distribution of the toners can be uniformized. It is considered that the ether bond has high molecular mobility, accordingly a bond angle of the ether bond changes in the molecule, and the alleviation of the charges is promoted.

Finally, regarding the configuration requirement iii), in the surface region, the concentration of the ether bonds represented by —C—O—C— is higher on the outer surface (second surface) side of the elastic layer than on the surface (first surface) side of the opposite side, which thereby prevents the charges from leaking to the elastic layer from the toners more than required, particularly in the high temperature and high humidity environment (for example, temperature of 30° C. and relative humidity of 85%).

In other words, the ether bond has high hydrophilicity, and tends to easily attract moisture, particularly in the high temperature and high humidity environment. Because of this, if ether bonds exist uniformly in a thickness direction of the elastic layer, a resistance of the whole elastic layer becomes low in the high temperature and high humidity environment, and the charges of the toners result in easily leaking down to the first surface side of the elastic layer. As a result, the charges result in leaking to the base material or an electroconductive intermediate layer which is located on the opposite side of the outer surface side of the elastic layer.

On the other hand, it is considered that adoption of the structure according to the configuration requirement iii) can make it difficult for the charges from the toner to reach the first surface side of the elastic layer.

A developing member according to the present disclosure will be described below as one aspect of the developing member according to the present disclosure, referring to a developing member having a roller shape (hereinafter, also referred to as "developing roller"), as an example. The shape of the developing member according to the present disclosure is not limited to the roller shape.

Figure 1B:
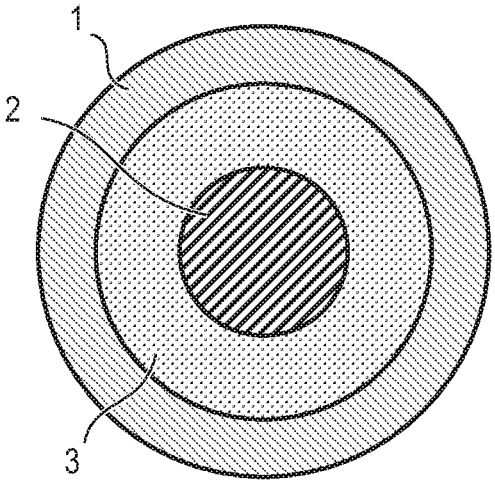

The developing roller has an elastic layer having a monolayer structure 1 as a surface layer, as illustrated in FIGS. 1A and 1B, for example. In addition, the developing roller has an electroconductive substrate inside of the surface layer. As for the electroconductive substrate, a mandrel 2 which becomes a support member may be provided so as to be in direct contact with the surface layer 1 as illustrated in FIG. 1A, or a substrate may be used in which further one layer or a plurality of electroconductive intermediate layers 3 are provided between the mandrel 2 and the surface layer 1 as needed as illustrated in FIG. 1B. For example, in a process of a non-magnetic one-component contact development system, a developing member is preferably used in which a surface layer is provided on an electroconductive substrate in which an intermediate layer is laminated on a mandrel.

[Electroconductive Substrate]

An electroconductive substrate is defined to be a substrate in which at least the surface on which the elastic layer is formed has electroconductivity. A preferable volume resistance of the electroconductive surface is, for example, $1.0\times10^{3}$ Ω·cm or less, and particularly $10^{-3}$ Ω·cm or less, in terms of volume resistance. Examples of a material of such a substrate include: metals or alloys such as aluminum, copper alloys and stainless steel; iron plated with chromium or nickel; and synthetic resins having electroconductivity.

In addition, it is also possible to use a substrate made from a resin, of which the outer surface becomes electroconductive by having one or more layers of a thin film formed by plating of a metal or an alloy.

When the developing member is a developing roller, a columnar or cylindrical electroconductive mandrel can be used in the state as the substrate, or can be used in a state where one layer or a plurality of electroconductive intermediate layers are further provided on the mandrel.

[Elastic Layer]

The elastic layer is a surface layer constituting the outermost layer of the developing member. Accordingly, a surface (second surface) opposite to a surface (first surface) of the elastic layer facing the substrate coincides with the outer surface of the developing member. In addition, the second surface is also a surface which comes into contact with the toner particles.

The elastic layer which is the surface layer is formed of a mono-layer, and has a thickness of T (μm).

The thickness T of the elastic layer is preferably 3.0 μm or more, and more preferably is 5.0 μm or more and 150.0 μm or less.

The elastic layer has a volume resistivity of $1.0\times10^{5}$ Ω·cm or more and $1.0\times10^{12}$ Ω·cm or less, and preferably is $1.0\times10^{6}$ Ω·cm or more and $1.0\times10^{10}$ Ω·cm or less. A method of measuring the volume resistivity of the elastic layer will be described later.

Controlling the volume resistivity of the elastic layer to be within the above range can prevent an excessive leakage of the charges from the toner particles carried on its surface, and uniformize the charging distribution of the toners.

In addition, the elastic layer contains the first resin that is the main binder, and the surface region of the elastic layer further contains the second resin having a structural unit represented by Structural Formula (1).

Structural Formula (1)

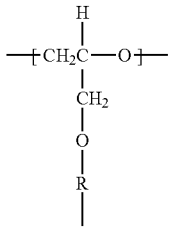

By containing the second resin having the above structural unit that has an ether bond represented by —C—O—C— having a high molecular mobility in the surface region, the developing member can transfer excess charges to the surface region, even though the toner particles carried on the surface of the developing member are excessively charged. As a result, the charging distribution of the toners can be uniformized.

R in Structural Formula (1) is a linear or branched hydrocarbon group having 1 to 6 carbon atoms. This is because the concentration of the ether bonds in Structural Formula (1) becomes higher as the number of carbon atoms becomes lower, and it becomes easier to cause the transfer of the charges from the excessively charged toner particles to the surface region.

It is preferable for the depth t (μm) of the surface region to be 1.0 μm or more and less than 3.0 μm, and is particularly preferable to be 1.0 μm or more and 1.5 μm or less, from the viewpoint of releasing the charges of the excessively charged toner particles, but preventing the charges from excessively leaking from the toner particles.

[First Resin]

Examples of the first resin include an epoxy resin, a urethane resin, a urea resin, an ester resin, an amide resin, an imide resin, an amide-imide resin, a phenol resin, a vinyl resin, a silicone resin and a fluorine resin. Among them, not particularly limited, the urethane resin may preferably employed due to excellent in flexibility and strength.

[Second Resin]

Examples of the second resin include a polymer of a glycidyl ether monomer having a structure represented by the Structural Formula (2) in which R is the same definition as that in the Structural Formula (1).

Structural Formula (2)

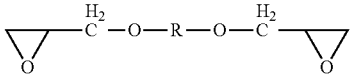

Alkyl glycidyl ether may preferably be used as the glycidyl ether monomer. Examples of those will be given below:

ethylene glycol diglycidyl ether, propylene glycol diglycidyl ether, 1,4-butanediol diglycidyl ether, 1,5-pentandiol diglycidyl ether, neopentyl glycol diglycidyl ether and 1,6-hexanediol diglycidyl ether.

A method for forming an elastic layer containing a polymer of the glycidyl ether monomer in the surface region will be described later.

[Filler]

The surface layer can further contain an electroconductive filler, for the purpose of controlling the volume resistivity and the reinforcing effect of the surface layer. Examples of the electroconductive filler include the following:

carbon-based materials such as carbon black and graphite; metals or alloys such as aluminum, silver, gold, tin-lead alloys and copper-nickel alloys; metal oxides such as zinc oxide, titanium oxide, aluminum oxide, tin oxide, antimony oxide, indium oxide and silver oxide; and materials of various fillers plated with an electroconductive metal such as copper, nickel and silver.

The carbon black is particularly preferably used as the electroconductive filler, because the electroconductivity is easily controlled and the cost is inexpensive.

[Ion Conductive Agent]

The surface layer can further contain an ion conductive agent, for the purpose of controlling the volume resistivity of the surface layer according to the present disclosure.

Examples of the material of the ion conductive agent include the following:

salts of metals in Group 1 of the periodic table such as $KCF_3SO_3$, $LiCF_3SO_3$, $LiN(CF_3SO_2)_2$, $NaClO_4$, $LiClO_4$, $LiAsF_6$, $LiBF_4$, NaSCN, KSCN and NaCl; ammonium salts such as $NH_4Cl$, $(NH_4)_2SO_4$ and $NH_4NO_3$; salts of metals in Group 2 of the periodic table such as $Ca(ClO_4)_2$ and $Ba(ClO_4)_2$; complexes of these salts with polyhydric alcohols such as 1,4-butanediol, ethylene glycol, polyethylene glycol, propylene glycol and polypropylene glycol, or with derivatives thereof; complexes of these salts with monools such as ethylene glycol monomethyl ether, ethylene glycol monoethyl ether, polyethylene glycol monomethyl ether and polyethylene glycol monoethyl ether; cationic surfactants such as quaternary ammonium salts; anionic surfactants such as aliphatic sulfonates, alkyl sulfate ester salts and alkyl phosphate ester salts; and amphoteric surfactants such as betaine.

Among the materials, $KCF_3SO_3$, $LiCF_3SO_3$ and $LiN(CF_3SO_2)_2$ are particularly preferably used, because the uniformity and stability of the electric resistance value of the surface layer are good.

[Fine Particle for Roughness Control]

When it is necessary to impart roughness to the second surface, a fine particle for controlling the roughness of the second surface can be contained in the surface layer.

The content of the fine particle for roughness control is preferably 1 to 50 parts by mass with respect to 100 parts by mass of the resin component of the surface layer. As for the fine particle for the roughness control, fine particles can be used such as a polyurethane resin, a polyester resin, a polyether resin, a polyamide resin, an acrylic resin and a phenol resin.

It is preferable for the volume average particle size of the fine particles for the roughness control to be 1.0 μm or more and 30 μm or less, and is more preferable to be 3.0 μm or more and 20 μm or less.

It is preferable for the surface roughness (ten-point average roughness) Rzjis of the second surface, which is formed by the fine particles, to be 0.1 μm or more and 20 μm or less. Rzjis is a value measured based on JISB0601 (1994).

[Other Components]

In addition to materials described so far, the elastic layer can contain an electroconductive substance, a crosslinking agent, a plasticizer, a filler, an extender, a vulcanizing agent, a vulcanizing aid, a crosslinking aid, an antioxidant, an anti-aging agent, a processing aid and a leveling agent in a range that does not impair the above functions.

Furthermore, in the surface region of the elastic layer, the concentration of the ether bonds is higher on the second surface side than on the first surface side. The measuring method will be described later. By having such a configuration, the elastic layer prevents the excessive charges from leaking to the elastic layer from the toners, particularly in the high temperature and high humidity environment (for example, a temperature of 30° C. and relative humidity of 85%), as has been described above.

[Method for Forming Surface Layer]

The elastic layer having the above requirements i) to iii) can be formed by a method including, for example, the following steps p1) to p3).

The step p1) is a step of forming a resin layer containing the first resin as the main binder resin on the electroconductive substrate;

the step p2) is a step of impregnating the resin layer with an impregnation treatment liquid containing a raw material of the second resin, from the outer surface;

and the step p3) is a step of curing the raw material of the second resin, with which the resin layer has been impregnated.

In the step p1, the formation of the resin layer containing the first resin is not particularly limited, and a coating shaping method is preferable which uses a liquid coating material that contains a first resin or a raw material of the first resin (for example, raw material of at least one selected from the group consisting of a monomer, an oligomer and a prepolymer).

For example, the resin layer can be formed, by dispersing and mixing each material for forming the resin layer including the raw material of the first resin in a solvent to prepare a coating material; applying the coating material onto the electroconductive substrate; and drying and solidifying or heating and curing the coating material.

The solvent is preferably selected from the viewpoint of compatibility with the main binder resin. For example, when the first resin is a urethane resin, at least one solvent can be used which is selected from the group consisting of alcohol (for example, methanol, ethanol and n-propanol), ketone (for example, acetone, methyl ethyl ketone and methyl isobutyl ketone), and an ester (for example, methyl acetate and ethyl acetate), and has good compatibility with another material.

For mixing, a known dispersion apparatus which uses beads, such as a sand mill, a paint shaker, a dyno mill and a pearl mill can be used. In addition, as for the coating method, dip coating, ring coating, spray coating or roll coating can be used.

In the step p2, the resin layer is impregnated with an impregnation treatment liquid containing a glycidyl ether monomer, from the outer surface of the resin layer formed as described above. By being impregnated with an impregnation treatment liquid in which the glycidyl ether monomer is appropriately diluted by various solvents, a surface layer of which the surface composition is more uniform can be formed.

The glycidyl ether monomer is preferably a low-molecular glycidyl ether, from the viewpoint of easy impregnation of the first resin. In addition, from a similar viewpoint, because the first resin is more easily impregnated with a monomer having lower viscosity, an aliphatic glycidyl ether monomer which does not have a rigid structure in the main chain and has low viscosity is preferable. Specific examples of the glycidyl ether monomer shown by the above Structural Formula (2) satisfy these conditions.

The solvent can be freely selected as long as the solvent satisfies both of the compatibility with the resin layer and the glycidyl ether monomer solubility. Examples thereof include: alcohols such as methanol, ethanol and n-propanol; ketones such as acetone, methyl ethyl ketone and methyl isobutyl ketone; and esters such as methyl acetate and ethyl acetate. In addition, a polymerization initiator can be appropriately mixed in the impregnation treatment liquid. The details of the polymerization initiator will be described later. The impregnation method with the impregnation treatment liquid is not particularly limited, and dip coating, ring coating, spray coating or roll coating can be used.

Next, in the step p3, the glycidyl ether monomer is polymerized with which the resin layer has been impregnated, and thereby, the elastic layer which further contains the second resin in addition to the first resin in the surface region can be formed.

The polymerization method is not particularly limited, and a known method can be used. Specifically, the method includes methods such as thermosetting and ultraviolet irradiation. In particular, the method of curing the glycidyl ether monomer by irradiation with ultraviolet rays is more preferable, because the method does not volatilize the glycidyl ether monomer to the outside of the system due to the application of excessive heat, and can efficiently polymerize and cure the monomer in the system.

The depth t (μm) of the surface region can be adjusted by the adjustment of the depth impregnated with the impregnation treatment liquid, in the step p2. As for the impregnation depth, for example, when the dip coating method is employed, the impregnation depth of the resin layer from the outer surface can be adjusted, for example, by the adjustment of at least one of the viscosity of the impregnation treatment liquid and the immersion time period.

The polymerization method of the glycidyl ether monomer is not particularly limited, and a known method can be used. Specific examples thereof include heat polymerization by heating and photopolymerization such as irradiation with ultraviolet rays, which use ultraviolet rays, electron beams, heat and the like.

In each of the polymerization methods, a polymerization initiator can be used such as a known radical polymerization initiator and ionic polymerization initiator. In addition, these polymerization initiators may be used singly, or in combinations of two or more.

In addition, the polymerization initiator blended is preferably used in an amount of 0.5 parts by mass or more and 10 parts by mass or less when the total amount of the compound (for example, compound having a glycidyl group) for forming a particular resin is 100 parts by mass, from the viewpoint of efficiently proceeding the reaction.

In addition, a known apparatus can be appropriately used as the apparatus for heating and the apparatus for ultraviolet irradiation. Examples of usable light sources for emitting ultraviolet rays include: an LED lamp, a high-pressure mercury lamp, a metal halide lamp, a xenon lamp and a low-pressure mercury lamp. The integrated light quantity necessary for the polymerization can be appropriately adjusted according to the type of the compound and the polymerization initiator to be used and the amount of the compound and the initiator to be added.

The second surface of the elastic layer is a surface carrying the toner particles thereon, and when the toner particles are stuck on the second surface by long-term use, the surface is configured as if an insulating thin film were formed on the elastic layer, and the rapid charge transfer from the excessively charged toner particles to the surface region can be hindered. Because of this, the MD-1 hardness measured at a temperature of 23° C. is preferably 30° or more and 40° or less on the outer surface of the developing member, from the viewpoint of preventing the toner particles from sticking to the second surface. Thereby, the stress onto the toner particles by the developing member can be moderated, and adhesion of the toner particles can be suppressed.

[Intermediate Layer]

An electroconductive intermediate layer may be provided between the electroconductive substrate and the elastic layer. The intermediate layer may provide the developing member a hardness and elasticity to form an appropriate nip width and an appropriate nip pressure when pressing the developing member against the image carrier more easily.

The intermediate layer can become an electroconductive intermediate layer by blending an electroconductivity-imparting agent such as an electron conductive substance or an ion conductive substance into the above rubber material, and the volume resistivity of the intermediate layer is preferably adjusted to $1.0\times10^{3}$ Ω·cm or more and $1.0\times10^{11}$ Ω·cm or less, and is more preferably to $1.0\times10^{4}$ Ω·cm or more and $1.0\times10^{10}$ Ω·cm or less.

Due to the intermediate layer being provided, an interface results in being formed between the elastic layer and the intermediate layer, but because the concentration of the ether bonds on the first surface side of the elastic layer is lowered than that on the second surface side, it becomes difficult for the charges to accumulate at the interface.

In addition, when the volume resistivity of the intermediate layer is controlled to be within the above range, the charges which have reached the first surface side of the elastic layer can be passed to the intermediate layer. Due to this, accumulation of the charges at the interface between the elastic layer and the intermediate layer can be better suppressed.

The intermediate layer is preferably formed of a shaped body of a rubber material. The rubber material includes the following: ethylene-propylene-diene copolymer rubber (EPDM), acrylonitrile-butadiene rubber (NBR), chloroprene rubber (CR), natural rubber (NR), isoprene rubber (IR), styrene-butadiene rubber (SBR), fluorine rubber, silicone rubber, epichlorohydrin rubber, a hydride of NBR, and urethane rubber. These materials can be used singly, or in combinations of two or more. Among these materials, the silicone rubber is particularly preferable which resists causing compression permanent deformation in the electroconductive intermediate layer even when another member (toner regulating member or the like) has come into contact with the intermediate layer over a long period of time. Specific examples of the silicone rubber include a cured product of an addition curing type silicone rubber.

Examples of the electron conductive substance include the following substances: electroconductive carbon black such as electroconductive carbon, carbon for rubber and carbon for color (ink); metals; and metal oxides thereof. Examples thereof are highly electroconductive carbon such as ketjen black EC and acetylene black; carbon for rubber such as SAF, ISAF, HAF, FEF, GPF, SRF, FT and MT; carbon for color (ink) that is carbon black powder which has been subjected to oxidation treatment; metals such as copper, silver and germanium; and metal oxides thereof. Among these substances, the electroconductive carbon black [electroconductive carbon, carbon for rubber and carbon for color (ink)] is preferable, because the electroconductivity can be easily controlled by a small amount.

Examples of the ion conductive substance include the following substances: inorganic ion conductive substances such as sodium perchlorate, lithium perchlorate, calcium perchlorate and lithium chloride; and organic ion conductive substances such as modified aliphatic dimethylammonium ethosulfate and stearylammonium acetate.

These electroconductivity-imparting agents are used in an amount necessary for adjusting the volume resistivity of the intermediate layer to the appropriate value as described above, and are used in the range of 0.5 parts by mass or more and 50 parts by mass or less with respect to 100 parts by mass of the rubber material constituting the intermediate layer.

The intermediate layer can further contain various additives such as a plasticizer, a filler, an extender, a vulcanizing agent, a vulcanizing aid, a crosslinking aid, a curing inhibitor, an antioxidant, an anti-aging agent and a processing aid, as needed. Examples of the filler include silica, quartz powder and calcium carbonate. These optional components are blended in amounts in ranges that do not impair the function of the intermediate layer.

Preferably, the intermediate layer has elasticity required for the developing member, has an Asker C hardness (JIS K7312) of 20 degrees or more and 100 degrees or less, and has a thickness of 0.3 mm or more and 6.0 mm or less.

Materials for the intermediate layer can be mixed with each other, using a dynamic mixing apparatus such as a uniaxial continuous kneader, a biaxial continuous kneader, a two-roll, a kneader mixer and a trimix, or a static mixing apparatus such as a static mixer.

A method for forming the intermediate layer on the electroconductive substrate is not particularly limited, and includes a die molding method, an extrusion method, an injection molding method and a coating shaping method. Example of the die molding method includes: first fixing dies for holding a mandrel in a mold, on both ends of the cylindrical mold, respectively, and forming an injection port in the die; and next, arranging the mandrel in the mold, injecting the material for the intermediate layer from the injection port, then heating the mold at a temperature at which the material is cured, and demolding the resulting product. Example of the extrusion method includes a method of extruding the materials of the mandrel and the intermediate layer together using a crosshead type extruder, curing the materials, and forming the intermediate layer around the mandrel.

The surface of the intermediate layer can be also modified by surface modification methods of surface polishing, corona treatment, flame treatment and excimer treatment, in order to improve adhesiveness with the surface layer.

[Process Cartridge and Electrophotographic Image Forming Apparatus]

Figure 2:
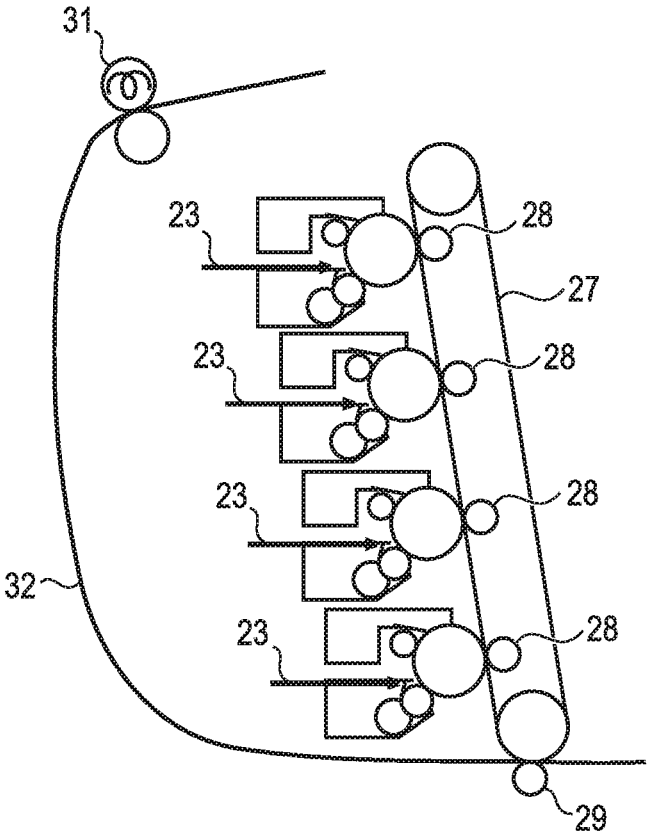
FIG. 2 shows a schematic configuration diagram illustrating one example of an electrophotographic image forming apparatus according to the present disclosure.

An electrophotographic image forming apparatus according to one aspect of the present disclosure is an apparatus having: an image carrier for carrying an electrostatic latent image thereon; a charging apparatus for primarily charging the image carrier; an exposure apparatus for forming the electrostatic latent image on the primarily charged image carrier; a developing apparatus for developing the electrostatic latent image with toner to form a toner image; and a transfer apparatus for transferring the toner image onto a transfer material. FIG. 2 shows a cross-sectional view illustrating an outline of the electrophotographic image forming apparatus according to one embodiment of the present disclosure.

Figure 3:
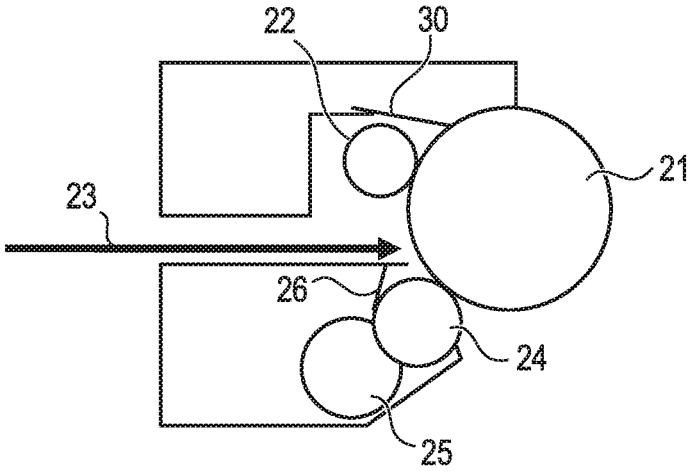
FIG. 3 shows a schematic configuration diagram illustrating one example of a process cartridge according to the present disclosure.

FIG. 3 shows an enlarged cross-sectional view of the process cartridge according to one aspect of the present disclosure, which is configured to be detachably attachable, for example, to the electrophotographic image forming apparatus of FIG. 2. The process cartridge houses; an image carrier 21 such as a photosensitive drum; a charging apparatus equipped with a charging member 22; a developing apparatus equipped with a developing member 24, and a cleaning apparatus equipped with a cleaning member 30. In addition, the process cartridge is configured to be detachably attachable to the main body of the electrophotographic image forming apparatus of FIG. 2.

The image carrier 21 is uniformly charged (primary charging) by the charging member 22 which is connected to an unillustrated bias power source. At this time, the charged potential of the image carrier 21 is −800 V or more and −400 V or less. Next, the image carrier 21 is irradiated with exposure light 23 for writing an electrostatic latent image by an unillustrated exposure apparatus, and has the electrostatic latent image formed on its surface. As the exposure light 23, both of LED light and laser light can be used. The surface potential of the exposed portion on the image carrier 21 is −200 V or more and −100 V or less.

Next, the toner charged to negative polarity is given (developed) onto the electrostatic latent image by the developing member 24, a toner image is formed on the image carrier 21, and the electrostatic latent image is converted into a visible image. At this time, a voltage of −500 V or more and −300 V or less is applied to the developing member 24 by an unillustrated bias power source. In addition, the developing member 24 is in contact with the image carrier 21, with a nip width of 0.5 mm or more and 3 mm or less. In the process cartridge of the present embodiment, a toner supply roller 25 is contacted with the developing member 24 in a rotatable state, on an upstream side of the rotation of the developing member 24, with respect to a contact portion between the developing blade 26 which is a toner regulating member and the developing member 24.

The toner image developed on the image carrier 21 is primarily transferred to the intermediate transfer belt 27. A primary transfer member 28 is in contact with the back surface of the intermediate transfer belt 27, and primarily transfers a negative-polarity toner image from the image carrier 21 to the intermediate transfer belt 27, due to a voltage of +100 V or more and +1500 V or less being applied to the primary transfer member 28. The primary transfer member 28 may have a roller shape or a blade shape.

When the electrophotographic image forming apparatus is a full-color image forming apparatus, each of the above steps of charging, exposure, development and primary transfer is performed for each color of yellow, cyan, magenta and black. For this purpose, in the electrophotographic image forming apparatus illustrated in FIG. 2, a total of four process cartridges which contain the toners of the above colors, respectively, are installed in a state of being detachably attachable to the main body of the electrophotographic image forming apparatus. Then, each of the above steps of charging, exposure, development and primary transfer is sequentially executed with a predetermined time difference, and the state is created on the intermediate transfer belt 27, in which toner images of four colors for expressing a full-color image are superimposed.

The toner image on the intermediate transfer belt 27 is conveyed to a position facing the secondary transfer member 29, along with the rotation of the intermediate transfer belt 27. A recording sheet is conveyed between the intermediate transfer belt 27 and the secondary transfer member 29, along a conveyance route 32 of a recording sheet, at the predetermined timing, and the toner image on the intermediate transfer belt 27 is transferred onto the recording sheet by a secondary transfer bias being applied to the secondary transfer member 29. At this time, the bias voltage applied to the secondary transfer member 29 is +1000 V or more and +4000 V or less. The recording sheet onto which the toner image has been transferred by the secondary transfer member 29 is conveyed to a fixing apparatus 31 along the conveyance route 32 of the recording sheet, the toner image on the recording sheet is melted and fixed onto the recording sheet, then the recording sheet is discharged to the outside of the electrophotographic image forming apparatus, and thereby the printing operation is completed.

The toner which has not been transferred from the image carrier 21 to the intermediate transfer belt 27 and has remained on the image carrier 21 is scraped off by a cleaning member 30 for cleaning the surface of the image carrier 21, and the surface of the image carrier 21 is cleaned.

According to one aspect of the present disclosure, a developing member that can form a stably high-quality electrophotographic image under various usage environments can be obtained.

In addition, according to another aspect of the present disclosure, a process cartridge that can stably form a stably high-quality electrophotographic image under various usage environments can be obtained. Furthermore, according to the present disclosure, an electrophotographic image forming apparatus that can form a stably high-quality electrophotographic image under various usage environments can be obtained.

EXAMPLE

The present disclosure will be described in more detail below with reference to specific Examples, while taking a roller-shaped developing member as an example. The technical scope of the developing member in the present disclosure is not limited to these Examples.

Example 1

[Production of Electroconductive Substrate]

A primer (trade name: DY35-051, manufactured by Toray Dow Corning Co., Ltd.) was applied to a metal core which was made from SUS304 and had an outer diameter of 6 mm and a length of 270 mm, and was heated at a temperature of 150° C. for 20 minutes. This metal core was set in a cylindrical mold having an inner diameter of 12 mm so as to become concentric with the mold. Onto the inner wall of the cylindrical mold, 0.3 g of a release agent (trade name: Fluorosurf, FG-5093F130-0.5, manufactured by Fluoro Technology Co., Ltd.) was spray-coated, and the mold was assembled.

As a material of an intermediate layer, an addition-type silicone rubber composition obtained by mixing materials shown in the following Table 1 with a trimix (trade name: TX-15 manufactured by Inoue Seisakusho) was injected into a mold heated to a temperature of 115° C. After having been injected, the material was heated and molded at a temperature of 120° C. for 10 minutes, was cooled to room temperature, and then was removed from the mold; and thereby an elastic roller was obtained in which an intermediate layer having a thickness of 2.98 mm was formed on the outer circumference of the electroconductive substrate.

TABLE 1

| Material | Parts by mass |
|---|---|
| Liquid dimethyl polysiloxane having two or more silicon atom-bonded alkenyl groups in one molecule (trade name: SF3000E, viscosity 10000 cP, vinyl group equivalent 0.05 mmol/g, manufactured by KCC Corp.) | 100 |
| Platinum-based catalyst (trade name: SIP6832.2, manufactured by Gelest, Inc.) | 0.048 |
| Dimethyl polysiloxane having two or more silicon atom-bonded hydrogen atoms in one molecule (trade name: SP6000P, Si—H group equivalent 15.5 mmol/g, manufactured by KCC Corp.) | 0.5 |
| Carbon Black (trade name: Toka Black #7360SB, manufactured by TOKAI CARBON CO., LTD.) | 6 |

[Formation of Surface Layer]

In forming the surface layer, first, a resin layer is formed. As materials for the resin layer, materials other than a fine particle for roughness control in a coating material 1 for the resin layer in the following Table 2 were mixed and stirred. After that, the mixture was dissolved in methyl ethyl ketone (manufactured by KISHIDA CHEMICAL Co., Ltd.) so that a concentration of the solid content became 30% by mass, was mixed, and then was uniformly dispersed with a sand mill.

To this mixed liquid, methyl ethyl ketone was added to adjust the concentration of the solid content to 25% by mass; the fine particle for roughness control described in Table 2 was added to the mixture, and was stirred and dispersed by a ball mill; and the coating material 1 for the resin layer was obtained.

The previously produced elastic roller was immersed in the coating material 1 for the resin layer, and thereby, the coating material 1 was applied, and heated at a temperature of 130° C. for 60 minutes to form the resin layer having a thickness of 10.1 μm.

TABLE 2

| Material | Parts by mass |
|---|---|
| Polyether polyol (trade name: PTGL1000, manufactured by Hodogaya Chemical Co., Ltd.) | 100 |
| Polymeric MDI (trade name: MR-400, Tosoh Corporation) | 37.2 |
| Carbon black (trade name: SUNBLACK X15, manufactured by Asahi Carbon Co., Ltd.) | 29.3 |
| Silica (trade name: AEROSIL50, manufactured by NIPPON AEROSIL CO., LTD.) | 4.3 |
| Fine particle for roughness control (trade name: Dymic beads UCN-5150, manufactured by Dainichiseika Color & Chemicals Mfg. Co., Ltd.) | 17.8 |

Subsequently, impregnation with a glycidyl ether monomer and curing treatment was performed by the following method.

As for materials for the impregnation treatment liquid for the impregnation treatment, materials shown in the following Table 3 were mixed and dissolved. The elastic roller produced in the above, on which the resin layer was formed, was immersed in the impregnation treatment liquid for 2 seconds, and was impregnated with the glycidyl ether monomer.

After that, the resulting elastic roller was air-dried at a temperature of 23° C. for 30 minutes and further dried at a temperature of 90° C. for 1 hour; and the solvent was volatilized. The elastic roller after having been dried was irradiated, while being rotated, with ultraviolet rays so that the integrated light amount became 15000 mJ/cm$^2$ to cure the glycidyl ether monomer, and the developing member (developing roller) 1 was obtained. In addition, a high-pressure mercury lamp (trade name: handy type UV curing apparatus, MDH2501N-02, manufactured by Mario Network) was used as an ultraviolet-ray irradiating apparatus.

TABLE 3

| Material | Parts by mass |
|---|---|
| Bifunctional glycidyl ether monomer (trade name: Ethylene glycol diglycidyl ether, manufactured by Tokyo Chemical Industry Co., Ltd.) | 5 |
| Photopolymerization initiator (trade name: San-Aid SI-110L, manufactured by SANSHIN CHEMICAL INDUSTRY CO., LTD.) | 0.1 |
| Solvent (trade name: Methyl ethyl ketone, manufactured by KISHIDA CHEMICAL Co., Ltd.) | 100 |
| Polyether monool (trade name: NEWPOL 50HB100, manufactured by Sanyo Chemical Industries, Ltd.) | 3 |

[Method for Checking Structural Unit of Second Resin]

<1H-NMR Analysis Method>

The presence or absence of Structural Formula (1) in the region of t was checked using 1H-NMR (apparatus used: JMN-EX400, JEOL).

A sample was taken from a region having a depth of t μm from the outermost surface of the elastic layer and was subjected to measurement under the following conditions.

Measurement apparatus: FTNMR apparatus JNM-EX400 (manufactured by JEOL Ltd.);

Measurement frequency: 400 MHz;

Pulse conditions: 5.0 μs;

Frequency range: 10500 Hz;

Integration count: 64 times.

The bond of Structural Formula (1) was checked from a peak shift of a hydrogen atom indicated by * below in Structural Formula (1).

Structural Formula (1)

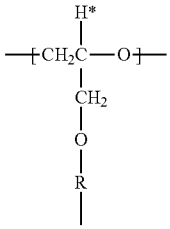

[Method for Checking Concentration of Ether Bonds]

<ESCA Measurement Method>

ESCA analyzer: trade name: Quantum 2000, manufactured by ULVAC-PHI Co., Ltd.

Elements to be detected: C, N, O and Si;

X-ray source: Monochrome AIKα;

X-ray Setting: 100 μmϕ (25 W (15 KV));

Photoelectron takeoff angle: 45 degrees;

Neutralization conditions: concomitant use of neutralizing gun and ion gun;

Analysis area: ϕ100 μm;

Pass Energy: 23.5 eV; and

Step size: 0.1 eV.

The concentration of ether bonds on the first surface and the second surface of the elastic layer is determined by atm % of the elements of C, N, O and Si that originates from the resin layer, which have been detected by a quantitative analysis by ESCA measurement, and by an area ratio between a C1s peak and an N1s peak which have been detected by a state analysis.

In addition, in the C1s peak, a peak detected at 285.0 eV was attributed to a C—C bond, the peak detected at 286.6 eV was attributed to a C—O bond, and a peak detected at 289.3 eV was attributed to a COO bond. Here, a value obtained by multiplying the atm % of an O element detected by the quantitative analysis and an abundance ratio between the C—C bond and the C—O bond determined by the state analysis of the C1s peak was defined as the concentration of the ether bonds in the present disclosure.

In the measurement of the concentration of the ether bonds in the present disclosure, three different locations on the first surface and the second surface were measured, and the mean value was used.

In addition, samples of each surface were collected using a microsampling method by FIB-SEM (trade name: NVision 40, manufactured by SII Nanotechnology).

Specifically, first, an incision was made from the surface of the developing roller toward the substrate using a razor, and a rubber piece in which the cross sections of the surface layer and the intermediate layer were exposed was cut out. The rubber piece was set on a sample stage of the SEM so that a cross section of the roller became the upper surface, and a sampling probe was fixed at a position corresponding to the roller surface of the rubber piece. Furthermore, a position corresponding to the inner side by 0.1 μm from the surface corresponding to the roller surface was subjected to a cutting process by FIB, and thereby a sample of the second surface was collected.

As for the first surface, a position deviating from the interface between the back surface of the surface layer and the intermediate layer toward the surface side by 1.0 was subjected to the cutting process by FIB. A sampling probe was fixed on the obtained cut surface, a position corresponding to 0.1 μm inside from the cut surface was subjected to a cutting process by FIB, and thereby a sample of the first surface was collected.

In any cutting process, an acceleration voltage of the FIB was 30 kV, and the beam current was 27 mA.

[Evaluation Method]

The developing member 1 produced in the above was subjected to evaluations of the following items.

<Evaluation 1: Measurement of Volume Resistivity of Elastic Layer>

A value obtained by the following method was adopted as the volume resistivity.

The elastic layer was cut out from the developing member, and a sample having a planar size of 50 μm square and a thickness d of 50 μm was produced with a microtome. Next, this sample was left as it is for 24 hours or more in an environment at a temperature of 23° C. and a relative humidity of 50%, and then was set on a metal flat plate; and the thin sample was pressed from above with a metal terminal having a pressing surface area S of 100 μm$^2$.

In this state, a voltage of 1 V was applied between the metal terminal and the metal flat plate using an electrometer (6517B type; manufactured by Keithley), and thereby the resistance R was obtained. From this resistance R, the volume resistivity ρv (Ω·cm) was calculated using following Expression (1).

$$\rho v = \text{resistance } R \times S/d \quad \text{Expression (1)}$$

The same operation was performed on three samples, and a three-point arithmetic mean value of volume resistivities ρv was obtained. The arithmetic mean of the obtained volume resistivities ρv was defined as the volume resistivity of the elastic layer.

<Evaluation 2-1; Method for Measuring Thickness T (μm) of Elastic Layer>

The thickness T μm of the elastic layer can be determined by observing a cross section in the thickness direction of the surface layer, for example, using a digital microscope (trade name: VHX-600; manufactured by Keyence) manufactured by Keyence Corporation, and measuring a distance from the interface between the elastic layer and the substrate to a flat part of the surface of the elastic layer. In the evaluation, this measurement was performed on arbitrary five cross sections, and the arithmetic mean value of the measurement values at these five points was defined as the thickness T of the elastic layer.

<Evaluation 2-2; Method for Measuring Depth t (μm) of Surface Region>

The depth t (μm) of the surface region was measured in the following way.

The elastic layers each having a thickness of 1 μm were sampled sequentially from the outer surface of the developing member, and the depth at which the existence of the structural unit of Structural Formula (1) could be checked by the above 1H-NMR analysis method was measured.

Next, the elastic layers between the depth closest to the substrate side, at which the structural unit of Structural Formula (1) was contained, and the depth closest to the outermost surface, at which the structural unit of Structural Formula (1) was not contained were sampled in increments of a depth of 0.1 μm, and similarly, the depth at which the structural unit of Structural Formula (1) was contained was measured by 1H-NMR analysis method.

The arithmetic mean value obtained by performing this sampling for n=3 times was defined as the region depth of t μm in which the structural unit of Structural Formula (1) was contained, in the depth direction from the surface.

<Evaluation 3: Measurement of MD-1 Hardness>

The developing member was left as it was for 24 hours in an environment having a temperature of 23° C. and a relative humidity of 53%. Next, the hardnesses of twelve points were measured in increments of 90° in the circumferential direction in the middle part and positions of 20 mm inside from both ends of the developing member, using a push needle having a diameter of 0.16 mm, with a micro rubber hardness tester (trade name: MD-1capa, manufactured by Kobunshi Keiki Co., Ltd.), and the mean value of these measurement values was defined as MD-1 hardness.

The developing member 1 was mounted on a process cartridge for a color laser printer described below, and was evaluated using the color laser printer (trade name: HP Color Laser Jet Enterprise M652dn, manufactured by HP).

<Evaluation 4: Evaluation of Charge Retention Capability of Elastic Layer in Low Temperature and Low Humidity Environment>

The charge retention capability of the elastic layer was evaluated by radiating charges to the second surface of the elastic layer using a corona discharger, and measuring the residual charges after the radiation.

Examples of methods which are generally used for resistance measurement include volume resistivity and surface resistivity as are defined in Japanese Industrial Standard (JIS) K 6911. However, the method specifies measurement in a wide range, in units of millimeter, and referring to this method, it is not possible to strictly discuss the charge up in a microscopic viewpoint such as an effect exerted by the developing member, concerning roughness of images that are printed in the electrophotographic process. In other words, even if the volume resistivity and the surface resistivity are low in the elastic layer, if there are many insulating regions on the surface, the elastic layer cannot release the charges and causes the charge up.

In the method using the corona discharger in this investigation, the space electric field generated by the residual charges is measured by an electrometer, but the space electric field varies according to the amount of the residual charges on the elastic layer surface. Because of this, the method can evaluate the difference in the amount of the residual charges, which is caused by a difference based on the microscopic viewpoint as described above, regardless of the resistance.

In an elastic roller which is easily charged up, there are many residual charges, and accordingly, a potential value is measured high. For this reason, an average potential of the elastic roller was determined, and was used as an indicator of the charge up. The details will be described below.

The average potential of the produced elastic roller was measured by the following method.

Figure 4:
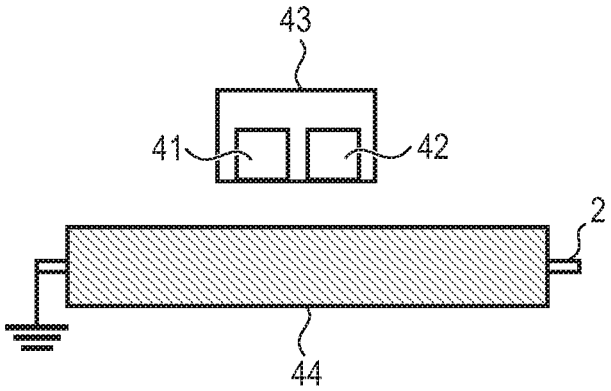
FIG. 4 shows a schematic diagram for describing an apparatus that measures an average potential and charge up of an elastic roller, in the present disclosure.

As an evaluation apparatus, a dielectric relaxation measuring apparatus (trade name: DRA-2000L; manufactured by QEA) was used. An outline of the dielectric relaxation measuring apparatus will be described based on FIG. 4. The apparatus is equipped with a head 43 in which a corona discharger 41 and a probe 42 of the surface electrometer are integrated.

In addition, the distance from a position at which corona discharge is performed in the head 43 by the corona discharger to the center of the probe of the surface electrometer is 25 mm, and accordingly, a delay time is generated between the end of the discharge and the time of measurement, according to a transferring speed of the head. The head 43 can transfer in parallel to the longitudinal direction of the developing member 44 which has been set. In addition, the charges generated in the corona discharger 41 are radiated toward the surface of the developing member 44.

The head 43 moves while performing the corona discharge, and thereby the potential is measured in the following way.

1) Charges are radiated from the corona discharger 41 to the surface of the developing member 44.

2) The charges on the surface of the developing member 44 escape to the ground through the electroconductive mandrel 2 during the delay time before the probe 42 of the electrometer reaches the measurement position.

3) The amount of residual charges on the surface of the developing member 44 is measured with an electrometer as a potential.

From the above measurement, the amount of the residual charges on the developing member, in other words, the charge up can be evaluated.

The evaluation apparatus and the produced developing member 1 were left as they were for 24 hours or more in a low temperature and low humidity (15° C./10% RH) environment, and were sufficiently aged.

In "DRA-2000L", a master which was made of stainless steel (SUS304) and had the same outer diameter as that of the developing member was set, and this master was short-circuited to the ground. Next, the distance between the surface of the master and the probe of the surface electrometer is adjusted to 0.76 mm, and was calibrated so that the surface electrometer becomes zero.

After the above calibration, the master was removed, and the developing member to be measured was set in DRA-2000L.

As for the measurement conditions, the corona discharger bias was set at 8 kV, the scanner transferring speed was set at 400 mm/sec, and the sampling interval was set at 0.5 mm or less; and the potential in the longitudinal direction of the developing member was measured. The range in which data was collected was set at 180 mm of the rubber part of the developing member excluding 27.5 mm in both ends. By the operation being repeated 36 times in increments of 10°, the potential data originating in the residual charges due to the corona discharge was obtained in the above measurement range.

The obtained potential data was expressed by a matrix of m rows and 36 columns, which arrays the values of the potentials obtained in the longitudinal positions in the vertical direction and the values of the potentials obtained in each phase in increments of 10° in the horizontal direction, as elements. The numerical value of m is determined according to the sampling interval.

The values of all the elements in the obtained matrix, in other words, the values of m×36 elements were arithmetically averaged, and the obtained value was defined as the average potential of the developing member.

<Evaluation 5: Evaluation of Presence or Absence of Roughness of Image and Degree of Roughness Thereof in Low Temperature and Low Humidity Environment>

The produced developing member 1 was subjected to the evaluation of the roughness of the image, by the following method.

The developing member 1 was mounted on the above process cartridge for the color laser printer, and was left as it was for 24 hours in a low temperature and low humidity environment having a temperature of 15° C. and a relative humidity of 10%. Thereafter, the process cartridge was mounted on the above color laser printer, and images with a low printing rate having a printing rate of 0.4% were continuously formed on 100,000 sheets of A4 size paper. Subsequently, one sheet of a halftone image with a printing density of 25% was output, this halftone image was visually observed, and the presence or absence of the roughness originating in the charge up of the developing member and the degree thereof were evaluated according to the following criteria.

Rank A: the image is smooth without a sense of roughness.

Rank B: there is little sense of roughness.

Rank C: there is a slight sense of roughness.

Rank D: there is the sense of roughness.

<Evaluation 6: Evaluation of Initial Fogging in High Temperature and High Humidity Environment>

Fogging is a phenomenon in which toner is slightly developed in a white part in which a toner image is not originally formed. The amount of fogging was evaluated in the following way.

On the way of a process of forming an image of a solid white, the electrophotographic apparatus was stopped. That is, at the time when an electrostatic latent image was developed with toner, but before the developed toner image was transferred, the electrophotographic apparatus was stopped. Then, the toner on the photosensitive member before transfer was transferred to an adhesive surface of a transparent adhesive tape, and the adhesive tape was stuck to a paper sheet. In addition, an adhesive tape on which toner was not adhered, was stuck to a paper sheet. The optical reflectivity was measured from the top of the adhesive tape (non-adhesive surface side) stuck to each paper sheet, using an optical reflectometer (trade name TC-6DS; manufactured by Tokyo Denshoku Co., Ltd.). Then, the amount of reflectivity corresponding to the fogging was obtained by subtracting a value of the optical reflectivity measured on the adhesive tape on which the toner did not adhere, from a value of the optical reflectivity measured on the adhesive tape onto which the toner adhered. This value was defined as the amount of fogging, and was evaluated according to the following criteria. The amount of fogging was determined from the mean value of values obtained by measurement at three points on each adhesive tape.

Rank A: the amount of fogging is less than 1.0%.

Rank B: the amount of fogging is 1.0% or more and less than 3.0%.

Rank C: the amount of fogging is 3.0% or more and less than 5.0%.

Rank D: the amount of fogging is 5.0% or more.

The evaluation of fogging was performed, after an operation of forming an image of a horizontal line having an image ratio of 5% on A4 size paper was continuously performed on 100 sheets in a high temperature and high humidity environment having a temperature of 30° C. and a relative humidity of 80%, using an electrophotographic apparatus which was left as it was for 24 hours. Here, the horizontal line with an image ratio of 5% was specifically an image in which horizontal lines having a width of 1 dot, which extend in a direction perpendicular to the rotation direction of the electrophotographic photosensitive member, are drawn at intervals of 19 dots in the rotation direction. In addition, the image of the horizontal lines was formed at a process speed of 120 mm/second, and a paper conveyance speed at the time of the evaluation of fogging was 60 mm/second.

<Evaluation 7: Evaluation of Degree of Leakage of Toner Charge to Developing Member>

An amount of toner charges was measured using an amount of charge/particle size distribution measuring apparatus (trade name: E-SPART analyzer; manufactured by Hosokawa Micron Group), and was calculated in a form of average Q/d [nC/μm]. Q is an amount of charges per one toner particle, and d is a particle size of the toner particle.

Specifically, similarly to the evaluation of fogging in the above evaluation 6, the image forming apparatus was stopped in the process of forming the image of the solid white; the average amounts of toner charges of the toners on the developing roller, which did not pass through the nip part yet and passed through the nip part, were measured using the above amount of charge/particle size distribution measuring apparatus; and the change in the distribution of the amount of charges of the toner, which was caused by passing of the toner through the nip part, was measured.

The greater the degree of leakage of toner charges to the developing member is, the more easily the charges of the toner particles become non-uniform. Specifically, the greater the degree of leakage of negative charges of the toner to the developing member is, the greater the proportion of toner particles positively charged with respect to the whole toner particles becomes.

Therefore, in this evaluation, the ratio (%) of the number of toners showing positive charge to the total number of toner components measured by the above "E-SPART analyzer" was calculated and was used as an indicator showing the degree of leakage of the charge of the toner to the developing member.

Examples 2 to 7, and 15 to 18

In the same manner as in Example 1, coating materials for resin layers were prepared from materials shown in Table 4, impregnation treatment liquids were prepared from materials shown in Table 5, and further developing members were produced by combinations as shown in Table 6. The obtained developing members were evaluated in the same manner as in Example 1.

Example 8

A developing member was produced in the same manner as in Example 1, except that the concentration of the solid content in the coating material for the resin layer before the fine particle for roughness control was mixed thereinto was set at 10% by mass, and thereby the film thickness of the resin layer was changed to 2.9 μm. The obtained developing member was evaluated in the same manner as in Example 1.

Examples 9 and 10

Developing members were produced in the same manner as in Example 1, except that the time period in which the elastic roller was immersed in the impregnation treatment liquid was changed to the time periods described in Table 6. The obtained developing members were evaluated in the same manner as in Example 1.

Example 11

A developing member was produced in the same manner as in Example 1, except that the concentration of the solid content in the coating material for the resin layer before the fine particle for roughness control was mixed thereinto was set at 18% by mass, and thereby the film thickness of the resin layer was changed to 5.1 μm. The obtained developing member was evaluated in the same manner as in Example 1.

Example 12

A developing member was produced in the same manner as in Example 1, except that the concentration of the solid content in the coating material for the resin layer before the fine particle for roughness control was mixed thereinto was set at 40% by mass, and thereby the film thickness of the resin layer was changed to 149.8 μm. The obtained developing member was evaluated in the same manner as in Example 1.

Example 13

A developing member was produced in the same manner as in Example 1, except that the concentration of the solid content in the coating material for the resin layer before the fine particle for roughness control was mixed thereinto was set at 15% by mass, and thereby the film thickness of the resin layer was changed to 4.0 μm. The obtained developing member was evaluated in the same manner as in Example 1.

Example 14

A developing member was produced in the same manner as in Example 1, except that the concentration of the solid content in the coating material for the resin layer before the fine particle for roughness control was mixed thereinto was set at 43% by mass, and thereby the film thickness of the resin layer was changed to 151.2 μm. The obtained developing member was evaluated in the same manner as in Example 1.

Example 19

A ϕ6 cylindrical electroconductive substrate and an unvulcanized rubber composition shown in Table 6 were integrally extruded using a crosshead extruder, and a roller was molded. An extruder having a cylinder diameter of 45 mm and L/D=20 was used as the extruder, and the temperatures at the time of extrusion were adjusted to 90° C. for a head, 90° C. for a cylinder, and 90° C. for a screw. The Mooney viscosity (JISK6300-1: 2013) of the rubber material was 50. In addition, a pressure to rubber at the time of the extrusion (pressure to rubber entering the crosshead from the extruder) was adjusted to 20 MPa. One sheet of metal mesh (mesh No. 100, wire diameter 100 μm, manufactured by Igeta, Inc.) is provided between the extruder and the crosshead, and the pressure to rubber is a pressure to the metal mesh part (extruder side) at the time of extrusion.

The molded and unvulcanized roller was vulcanized by being heated at 160° C. for 1 hour, and a vulcanized roller was obtained. Furthermore, a vulcanized roller having a shape with an elastic layer thickness of 2.98 mm was obtained by dry polishing using a rotating grindstone of a plunge type of polishing machine. An impregnation treatment liquid was prepared from the material shown in Table 5, and further a developing member was produced by the combination as shown in Table 6. The obtained developing member was evaluated in the same manner as in Example 1.

Comparative Example 1

A coating material for a resin layer was prepared from the material shown in Table 4 and a developing member was produced, in the same manner as in Example 1, except that the developing member was not subjected to the impregnation with the glycidyl ether monomer and to the curing treatment. The obtained developing member was evaluated in the same manner as in Example 1.

Comparative Examples 2 to 5

In the same manner as in Example 1, coating materials for resin layers were prepared from materials shown in Table 4, impregnation treatment liquids were prepared from materials shown in Table 5, and further developing members were produced by combinations as shown in Table 6. The obtained developing members were evaluated in the same manner as in Example 1.

TABLE 4

| Classification | Material name | Resin material 1 | 2 | 3 | 4 | 5 | 6 | 7 | 8 | 9 | 10 | 11 |
|---|---|---|---|---|---|---|---|---|---|---|---|---|
| Polyol | PTGL1000 | 100 | 100 | 100 | 100 | 100 | 100 | 100 | 100 | 100 | — | — |
| Isocyanate | MR-400 | 37.2 | 37.2 | 37.2 | 37.2 | 37.2 | 37.2 | 37.2 | 37.2 | 37.2 | — | — |
| Carbon black | SUNBLACK X15 | 20.6 | 41.2 | 6.9 | 48.0 | 2.7 | 20.6 | 20.6 | 20.6 | 20.6 | 40 | — |
| Silica | AEROSIL50 | 4.3 | 4.3 | 4.3 | 4.3 | 4.3 | 0.2 | 7.1 | — | 7.8 | — | — |
| Roughness forming particle | UCN-5150 | 17.8 | 17.8 | 17.8 | 17.8 | 17.8 | 17.8 | 17.8 | 17.8 | 17.8 | — | — |
| NBR/hydrin | Nipol DN401 LL/ EPICHLOMER CG102 | — | — | — | — | — | — | — | — | — | 70/30 | — |
| Cured product of polytetramethylene glycidyl ether | Epogosey PT | — | — | — | — | — | — | — | — | — | — | 100 |
| Zinc stearate | Zinc stearate | — | — | — | — | — | — | — | — | — | 3 | — |
| Stearic acid | Stearic Acid *Camellia* | — | — | — | — | — | — | — | — | — | 1 | — |

* The numerals in the table represent the respective amounts of the materials to be blended by parts by mass.

* The materials listed in the table are the following materials.

PTGL1000: polyol manufactured by Hodogaya Chemical Co., Ltd.

MR-400: trade name Millionate MR-400, isocyanate compound (polymeric MDI) manufactured by Tosoh Corporation.

SUNBLACK XI5: trade name, carbon black manufactured by Asahi Carbon

UCN-5150: trade name Dymic Beads UCN-5150, cross-linked urethane resin particle manufactured by Dainichiseika Color & Chemicals Mfg. Co., Ltd.

AEROSIL50: trade name, manufactured by NIPPON AEROSIL CO., LTD.

Nipol DN401LL: trade name, NBR manufactured by Zeon Corporation

EPICHLOMER CG102: trade name, hydrin rubber manufactured by OSAKA SODA CO., LTD.

EPOGOSEY PT: trade name, manufactured by YOKKAICHI CHEMICAL CO., LTD.

Zinc stearate: trade name, Zinc Stearate manufactured by NOF Corporation

Stearic acid: trade name, Stearic Acid Camellia manufactured by NOF Corporation

TABLE 5

| Classification | Material name | Impregnation treatment liquid 1 | 2 | 3 | 4 | 5 | 6 | 7 |
|---|---|---|---|---|---|---|---|---|
| Glycidyl ether monomer | Ethylene glycol diglycidyl ether | 5 | — | — | — | — | — | — |
| | Epolite 70P | — | 5 | — | — | — | — | — |
| | 1,4-butanediol diglycidyl ether | — | — | 5 | — | — | — | — |
| | Epolite 1600 | — | — | — | 5 | — | — | — |
| | Neopentyl glycol diglycidyl ether | — | — | — | — | 5 | — | — |
| | Polyethylene glycol dimethacrylate | — | — | — | — | — | 5 | — |
| | Bisphenol A diglycidyl ether | — | — | — | — | — | — | 5 |
| Initiator | San-Aid SI-110L | 0.1 | 0.1 | 0.1 | 0.1 | 0.1 | — | 0.1 |
| | IRGACURE184 | — | — | — | — | — | 0.25 | — |
| Solvent | Methyl ethyl ketone | 100 | 100 | 100 | 100 | 100 | 100 | 100 |

* The numerals in the table represent the respective amounts of the materials to be blended by parts by mass.

* The materials listed in the table are the following materials.

Ethylene glycol diglycidyl ether: trade name, manufactured by Tokyo Chemical Industry Co., Ltd.

Epolite 70P: trade name, propylene glycol diglycidyl ether manufactured by Kyoeisha Chemical Co., Ltd.

1,4-butanediol diglycidyl ether: trade name, manufactured by Tokyo Chemical Industry Co., Ltd.

Epolite 1600: trade name, manufactured by Kyoeisha Chemical Co., Ltd., 1,6-hexanediol diglycidyl ether Neopentyl glycol diglycidyl ether: trade name, manufactured by Tokyo Chemical Industry Co., Ltd.

Polyethylene glycol dimethacrylate: trade name, manufactured by Tokyo Chemical Industry Co., Ltd.

Bisphenol A diglycidyl ether: trade name, manufactured by Tokyo Chemical Industry Co., Ltd.

San-Aid SI-110L: photopolymerization initiator; PF6/aromatic sulfonium salt, manufactured by SANSHIN CHEMICAL INDUSTRY CO., LTD.

IRGACURE 184: photopolymerization initiator; 1-hydroxycyclohexyl phenyl ketone, manufactured by BASF

TABLE 6

| | Resin layer | Solid content at the time of coating | Impregnation treatment | Impregnation time period |
|---|---|---|---|---|
| Example 1 | Resin material 1 | 25 wt % | Impregnation treatment liquid 1 | 6 Seconds |
| Example 2 | Resin material 2 | 25 wt % | Impregnation treatment liquid 1 | 6 Seconds |
| Example 3 | Resin material 3 | 25 wt % | Impregnation treatment liquid 1 | 6 Seconds |
| Example 4 | Resin material 1 | 25 wt % | Impregnation treatment liquid 2 | 6 Seconds |
| Example 5 | Resin material 1 | 25 wt % | Impregnation treatment liquid 3 | 6 Seconds |
| Example 6 | Resin material 1 | 25 wt % | Impregnation treatment liquid 4 | 6 Seconds |
| Example 7 | Resin material 1 | 25 wt % | Impregnation treatment liquid 5 | 6 Seconds |
| Example 8 | Resin material 1 | 10 wt % | Impregnation treatment liquid 1 | 6 Seconds |
| Example 9 | Resin material 1 | 25 wt % | Impregnation treatment liquid 1 | 2 Seconds |
| Example 10 | Resin material 1 | 25 wt % | Impregnation treatment liquid 1 | 18 Seconds |
| Example 11 | Resin material 1 | 18 wt % | Impregnation treatment liquid 1 | 6 Seconds |
| Example 12 | Resin material 1 | 40 wt % | Impregnation treatment liquid 1 | 6 Seconds |
| Example 13 | Resin material 1 | 15 wt % | Impregnation treatment liquid 1 | 6 Seconds |
| Example 14 | Resin material 1 | 43 wt % | Impregnation treatment liquid 1 | 6 Seconds |
| Example 15 | Resin material 6 | 25 wt % | Impregnation treatment liquid 1 | 6 Seconds |
| Example 16 | Resin material 7 | 25 wt % | Impregnation treatment liquid 1 | 6 Seconds |
| Example 17 | Resin material 8 | 25 wt % | Impregnation treatment liquid 1 | 6 Seconds |
| Example 18 | Resin material 9 | 25 wt % | Impregnation treatment liquid 1 | 6 Seconds |
| Example 19 | Resin material 10 | — | Impregnation treatment liquid 1 | 6 Seconds |
| Comparative Example 1 | Resin material 11 | 25 wt % | — | — |
| Comparative Example 2 | Resin material 4 | 25 wt % | Impregnation treatment liquid 1 | 6 Seconds |
| Comparative Example 3 | Resin material 5 | 25 wt % | Impregnation treatment liquid 1 | 6 Seconds |
| Comparative Example 4 | Resin material 1 | 25 wt % | Impregnation treatment liquid 6 | 6 Seconds |
| Comparative Example 5 | Resin material 1 | 25 wt % | Impregnation treatment liquid 7 | 6 Seconds |

The evaluation results of Examples 1 to 19 and Comparative Examples 1 to 5 are shown in Table 7-1 and Table 7-2.

TABLE 7-1

| Example | Concentration of ether bonds (atm · %) Second surface side | First surface side | Evaluation 1 volume resistivity (Ω · cm) | Evaluation 2 T (μm) | t (μm) | Evaluation 3 MD-1 (°) | Evaluation 4 (V) | Evaluation 5 Evaluation rank | Evaluation 6 Evaluation rank | Evaluation 7 Before passing through nip (%) | After passing through nip (%) |
|---|---|---|---|---|---|---|---|---|---|---|---|
| 1 | 38 | 15 | $1.0 \times 10^8$ | 10.1 | 1.1 | 36.3 | 2.6 | A | A | 6% | 8% |
| 2 | 39 | 13 | $1.0 \times 10^5$ | 10.1 | 1.2 | 36.2 | 2.4 | A | B | 14% | 21% |
| 3 | 37 | 14 | $1.0 \times 10^{12}$ | 10.0 | 1.3 | 36.2 | 15.6 | B | A | 12% | 14% |
| 4 | 34 | 14 | $1.0 \times 10^8$ | 10.0 | 1.2 | 36.1 | 3.5 | B | A | 10% | 12% |
| 5 | 29 | 15 | $1.0 \times 10^8$ | 10.3 | 1.1 | 36.3 | 4.3 | B | A | 10% | 12% |
| 6 | 21 | 15 | $1.0 \times 10^8$ | 10.2 | 1.3 | 36.2 | 5.3 | B | A | 11% | 13% |
| 7 | 25 | 15 | $1.0 \times 10^8$ | 10.1 | 1.2 | 36.3 | 4.1 | B | A | 11% | 13% |
| 8 | 38 | 15 | $1.0 \times 10^8$ | 2.9 | 1.2 | 36.0 | 2.7 | A | B | 14% | 20% |
| 9 | 38 | 14 | $1.0 \times 10^8$ | 10.3 | 0.9 | 36.3 | 5.7 | B | A | 12% | 14% |
| 10 | 37 | 14 | $1.0 \times 10^8$ | 10.3 | 3.1 | 36.3 | 2.6 | A | B | 12% | 18% |
| 11 | 38 | 13 | $1.0 \times 10^8$ | 5.1 | 1.2 | 36.1 | 2.7 | A | B | 12% | 16% |
| 12 | 38 | 14 | $1.0 \times 10^8$ | 149.8 | 1.3 | 36.1 | 15.4 | B | A | 11% | 13% |
| 13 | 37 | 13 | $1.0 \times 10^8$ | 4.0 | 1.1 | 36.0 | 2.7 | A | B | 14% | 19% |
| 14 | 39 | 13 | $1.0 \times 10^8$ | 151.2 | 1.3 | 36.2 | 18.7 | B | A | 10% | 12% |
| 15 | 39 | 15 | $1.0 \times 10^8$ | 10.0 | 1.2 | 30.1 | 12.2 | B | A | 9% | 11% |
| 16 | 37 | 13 | $1.0 \times 10^8$ | 10.3 | 1.2 | 40.2 | 15.8 | B | A | 12% | 14% |
| 17 | 39 | 15 | $1.0 \times 10^8$ | 10.1 | 1.3 | 29.0 | 16.9 | B | A | 11% | 13% |
| 18 | 39 | 15 | $1.0 \times 10^8$ | 10.3 | 1.1 | 41.1 | 18.9 | B | A | 11% | 13% |
| 19 | 37 | 27 | $1.0 \times 10^8$ | 10.1 | 1.1 | 36.2 | 2.7 | A | B | 14% | 20% |

TABLE 7-2

| Comparative Example | Concentration of ether bonds (atm · %) Second surface side | First surface side | Evaluation 1 volume resistivity (Ω · cm) | Evaluation 2 T (μm) | t (μm) | Evaluation 3 MD-1 (°) | Evaluation 4 (V) | Evaluation 5 Evaluation rank | Evaluation 6 Evaluation rank | Evaluation 7 Before passing through nip (%) | After passing through nip (%) |
|---|---|---|---|---|---|---|---|---|---|---|---|
| 1 | 38 | 38 | $1.0 \times 10^{8}$ | 10.2 | 1.1 | 36.0 | 2.3 | A | D | 17% | 28% |
| 2 | 38 | 14 | $1.0 \times 10^{1}$ | 10.2 | 1.2 | 36.2 | 1.7 | A | C | 16% | 27% |
| 3 | 39 | 14 | $1.0 \times 10^{13}$ | 10.3 | 1.1 | 36.3 | 30.1 | C | A | 10% | 12% |
| 4 | 15 | 15 | $1.0 \times 10^{8}$ | 10.2 | 1.0 | 36.1 | 24.7 | D | A | 12% | 14% |
| 5 | 27 | 27 | $1.0 \times 10^{8}$ | 10.3 | 0.0 | 36.1 | 50.6 | C | A | 9% | 11% |

[Discussion of Evaluation Results]

Any of the developing members of Examples 1 to 19 has an elastic layer containing the first resin which is the main binder resin, wherein the elastic layer further contains a second resin having a structural unit represented by the following Structural Formula (1), in a region extending toward a first surface from a second surface by a depth oft μm, where the first surface is defined as a surface of the surface layer on a side facing the substrate, and the second surface is defined as a surface thereof opposite to the first surface, and in this region, the concentration of the ether bonds represented by —C—O—C—, is higher on the second surface side than on the first surface side; and thereby the charge up in the low temperature and low humidity environment and the leakage of the charge of the toner in the high temperature and high humidity environment are suppressed.

The volume resistivities of Examples 2 and 3 are $1.0\times10^{5}$ Ω·cm and $1.0\times10^{12}$ Ω·cm, respectively, but on the contrary, the volume resistivity of Example 1 is $1.0\times10^{8}$ Ω·cm, and because of this, the charge up in the low temperature and low humidity environment and the leakage of the charge of the toner in the high temperature and high humidity environment are suppressed at higher levels.

When Examples 4 to 7 and Example 1 are compared, the concentration of ether bonds on the surface is higher in Example 1 than in Examples 4 to 7, and accordingly the charge up in the low temperature and low humidity environment can be suppressed at a higher level. When Example 8 and Example 1 are compared, in Example 1, the film thickness of the surface layer is 3.0 μm or more, thereby a relative ratio of the concentration of ether bonds on the surface layer lowers, and accordingly the leakage of the charge of the toner in the high temperature and high humidity environment is suppressed at a higher level.

When Examples 9 and 10 and Example 1 are compared, in Example 1, t is in the range of 1.0 μm or more and less than 3.0 μm, and thereby the charge up in the low temperature and low humidity environment and the leakage of the charge of the toner in the high temperature and high humidity environment are suppressed at higher levels.

When Examples 13 and 14 and Examples 1 to 8, 11 and 12 are compared, in Examples 1 to 8, 11 and 12, the film thicknesses of the surface layers are in the range of 5.0 μm to 150 μm, and thereby the charge up in the low temperature and low humidity environment and the leakage of the charge of the toner in the high temperature and high humidity environment are suppressed at higher levels. When Examples 15 and 16, and Examples 17 and 18 are compared, since, in Example 15 and 17, the MD-1 hardnesses are smaller, the deterioration of the toner is more suppressed, and thereby the charge up in the low temperature and low humidity environment is suppressed at a higher level.

When Example 19 and Examples 1 to 18 are compared, the first resin is urethane, thereby the deterioration of the toner is suppressed, and thereby the charge up in the low temperature and low humidity environment is suppressed at a higher level.

On the other hand, as for the relation between the concentrations of the ether bonds in Comparative Example 1, the concentration on the first surface is equal to that on the second surface, and accordingly, the leakage of the charge of the toner is observed in the high temperature and high humidity environment.

In Comparative Example 2, the volume resistivity of the surface layer is below the range of $1.0\times10^{5}$ Ω·cm to $1.0\times10^{12}$ Ω·cm, and accordingly, the leakage of the charge of the toner is observed in the high temperature and high humidity environment.

In addition, in Comparative Example 3, the volume resistivity of the surface layer exceeds the range of $1.0\times10^{5}$ Ω·cm to $1.0\times10^{12}$ Ω·cm, and accordingly, the charge up is observed in the low temperature and low humidity environment.

In Comparative Example 4, an impregnating agent was an acrylic monomer, accordingly the concentration of ether bonds on the surface did not change, and the charge up was observed in the low temperature and low humidity environment. In Comparative Example 5, most of the bisphenol A glycidyl ether did not intrude into the resin layer and was exposed to the surface, and the first resin component could not be checked. Accordingly, as for the relation between the concentrations of the ether bonds, the concentration on the first surface was equal to that on the second surface, and thereby the leakage of the charge was observed in the high temperature and high humidity environment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-220277, filed Nov. 26, 2018, and Japanese Patent Application No. 2019-194684, filed Oct. 25, 2019, which are hereby incorporated by reference herein in their entirety.

What is claimed is:

1. A developing member for electrophotography comprising:

an electroconductive substrate; and an elastic layer having a mono-layer structure on the substrate as a surface layer, wherein the elastic layer has a thickness of T μm and a volume resistivity of $1.0\times10^{5}$ Ω·cm or more and $1.0\times10^{12}$ Ω·cm or less; and the elastic layer comprises a first resin as a main binder, and the elastic layer further comprises a second resin having a structural unit represented by the following Structural Formula (1), in a region extending toward a first surface from a second surface by a depth of 1 μm, where the first surface is defined as a surface of the elastic layer on a side facing the substrate, and the second surface is defined as a surface thereof opposite to the first surface, wherein in the region, a concentration of ether bonds represented by —C—O—C—, is higher on the second surface side than on the first surface side (provided that T>t):

Structural Formula (1)

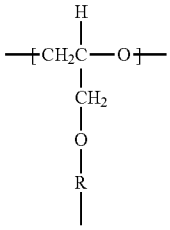

wherein R represents a linear or branched hydrocarbon group having 1 to 6 carbon atoms.

2. The developing member according to claim 1, wherein the T is 3.0 μm or more, and the t is 1.0 μm or more and less than 3.0 μm.

3. The developing member according to claim 2, wherein the T is 5.0 μm or more and 150.0 μm or less.

4. The developing member according to claim 1, wherein an MD-1 hardness of the developing member is 30° or more and 40° or less.

5. The developing member according to claim 1, wherein the first resin is a urethane resin.

6. A process cartridge configured to be detachably attachable to a main body of an electrophotographic image forming apparatus, comprising a developing member for electrophotography comprising:

an electroconductive substrate; and an elastic layer having a mono-layer structure on the substrate as a surface layer, wherein the elastic layer has a thickness of T μm and a volume resistivity of $1.0\times10^{5}$ Ω·cm or more and $1.0\times10^{12}$ Ω·cm or less; and the elastic layer comprises a first resin as a main binder, and the elastic layer further comprises a second resin having a structural unit represented by the following Structural Formula (1), in a region extending toward a first surface from a second surface by a depth of t μm, where the first surface is defined as a surface of the elastic layer on a side facing the substrate, and the second surface is defined as a surface thereof opposite to the first surface, wherein in the region, a concentration of ether bonds represented by —C—O—C—, is higher on the second surface side than on the first surface side (provided that T>t):

Structural Formula (1)

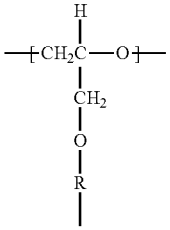

wherein R represents a linear or branched hydrocarbon group having 1 to 6 carbon atoms.

7. An electrophotographic image forming apparatus comprising: an image carrier for carrying an electrostatic latent image thereon; a charging apparatus for primarily charging the image carrier; an exposure apparatus for forming an electrostatic latent image on the primarily charged image carrier; a developing member for developing the electrostatic latent image by a toner to form a toner image; and a transfer apparatus for transferring the toner image to a transfer material, wherein the developing member is the a developing member for electrophotography comprising:

an electroconductive substrate; and an elastic layer having a mono-layer structure on the substrate as a surface layer, wherein the elastic layer has a thickness of T μm and a volume resistivity of $1.0\times10^{5}$ Ω·cm or more and $1.0\times10^{12}$ Ω·cm or less; and the elastic layer comprises a first resin as a main binder, and the elastic layer further comprises a second resin having a structural unit represented by the following Structural Formula (1), in a region extending toward a first surface from a second surface by a depth oft μm, where the first surface is defined as a surface of the elastic layer on a side facing the substrate, and the second surface is defined as a surface thereof opposite to the first surface, wherein in the region, a concentration of ether bonds represented by —C—O—C—, is higher on the second surface side than on the first surface side (provided that T>t):

Structural Formula (1)

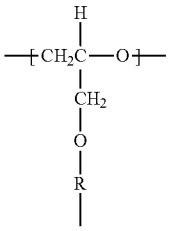

wherein R represents a linear or branched hydrocarbon group having 1 to 6 carbon atoms.

* * * * *